US007069683B1

(12) United States Patent
Kapusta

(10) Patent No.: US 7,069,683 B1
(45) Date of Patent: Jul. 4, 2006

(54) MAGAZINE AND SLIDE LEVER ASSEMBLY FOR A SEMI-AUTOMATIC FIREARM

(75) Inventor: John Kapusta, Belchertown, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/775,407

(22) Filed: Feb. 10, 2004

Related U.S. Application Data

(60) Provisional application No. 60/446,139, filed on Feb. 10, 2003.

(51) Int. Cl.
*F41A 17/36* (2006.01)

(52) U.S. Cl. ..... 42/70.02; 42/7; 42/50; 89/33.1; 89/190

(58) Field of Classification Search ..... 42/70.01, 42/70.02, 7, 50; 89/190, 33.1
See application file for complete search history.

(56) References Cited

U.S. PATENT DOCUMENTS

| | | | | |
|---|---|---|---|---|
| 1,381,590 | A * | 6/1921 | Oliver | 89/147 |
| 2,714,334 | A * | 8/1955 | Harvey | 89/190 |
| 3,098,311 | A * | 7/1963 | Savioli | 42/18 |
| 4,589,327 | A | 5/1986 | Smith | |
| 4,915,011 | A | 4/1990 | Smith | |
| 5,566,487 | A | 10/1996 | Vaid et al. | |
| 6,502,495 | B1 * | 1/2003 | Beary | 89/34 |

* cited by examiner

*Primary Examiner*—Stephen M. Johnson
(74) *Attorney, Agent, or Firm*—McCormick, Paulding & Huber LLP

(57) ABSTRACT

A firearm having a slide includes a magazine for accommodating a round of ammunition and a magazine follower disposed within the magazine. The magazine follower supports the round of ammunition and includes an outwardly extending protruding lip having a distal end which extends beyond a plane defined by an outer wall of the magazine.

17 Claims, 2 Drawing Sheets

MAGAZINE AND SLIDE LEVER ASSEMBLY FOR A SEMI-AUTOMATIC FIREARM

CROSS REFERENCE TO RELATED APPLICATIONS

This application claims the benefit of U.S. Provisional Application Ser. No. 60/446,139, filed on Feb. 10, 2003, and herein incorporated by reference in its entirety.

FIELD OF THE INVENTION

This invention relates in general to a magazine and slide lever assembly, and deals more particularly with a magazine and slide lever assembly that is capable of accommodating multiple caliber ammunition while assuredly latching the slide of the firearm in its open position.

BACKGROUND OF THE INVENTION

Semi-automatic firearms are well known and are often characterized by a magazine well formed in the grip of the firearm which is adapted to receive a magazine containing multiple rounds of ammunition therein. These magazines are themselves further characterized by a magazine follower and spring assembly which urges the stacked ammunition, round by round, into the firearm, automatically feeding ammunition after the previous round has been fired and the case extracted or ejected.

As shown in FIG. 1, a known magazine follower 10 sits atop a biasing spring and is positioned within the magazine 12, directly under the first round fed into the magazine. The spring is placed between a floor plate 14 at the bottom of the magazine and the magazine follower, and provides the necessary biasing force to urge the ammunition into the firing chamber. As shown in FIG. 1, the magazine 12 is in its empty position, with the magazine follower 10 in its extreme unloaded position.

Magazine followers generally move downward into the magazine when the magazine is loaded with ammunition. This compresses the spring and provides maximum return force. The magazine follower is urged upward by the spring force as ammunition is unloaded or as the weapon is fired.

One of the characteristics of certain semi-automatic firearms is that the slide is designed to stay open in the fully retracted mode after firing the last round in the magazine. This indicates that the firearm is empty of ammunition, and it also allows an operator to visually inspect the firing chamber and barrel.

Typically, semi-automatic firearms also include a slide lever integral to the frame which protrudes into the top of the magazine far enough to engage the follower, but not so far that the bullet will contact the slide lever and thereby cause the firearm to malfunction. In this regard, the slide lever is designed to take advantage of the characteristic of a standard cased round of ammunition. FIG. 2 illustrates a known slide lever 16, including a biasing arm 18 as well as a post 20 that is integrally mated to the firearm frame to provide selective rotation of the slide lever 16.

A round of ammunition comprises a bullet which sits atop and is engaged by a case which typically contains a primer and a propellant. Moreover, the overall shape of the round typically involves a lessened diameter at the top of the bullet as compared to the diameter at the bullet case interface, resulting in a substantial taper to the overall profile of the round.

When viewed from above then the round of ammunition will sit atop the magazine follower and there will be a portion of the follower which is not overlain by the round of ammunition due to the taper of the bullet.

Gun designers have taken advantage of these characteristics such that the biasing arm 18 on the slide lever 16 will contact the lip 22 of the magazine follower 10 as the magazine follower 10 rises in the magazine 12. After the last round has been expended from the magazine 12, the continued contact between the lip 22 and the biasing arm 18 causes the slide lever 16 to be rotated about the post 20, displacing the biasing arm 18 and a catch 24 upwards. A corresponding notch is cut in the slide of the firearm such that when the slide lever 16 is biased upwards, the catch 24 will engaged the notch in the slide, thereby stopping its forward movement.

Most bullets have a profile, or ojive, which is small enough to have an adequate distance between the outer edge of the bullet and the edge of the follower to allow engagement of the lip 22 with the biasing arm 18. Indeed, as shown in FIG. 2, the biasing arm 18 includes a tapered distal end 26 to help ensure that the rounds loaded in the magazine 12 are not interfered with by the biasing arm 18. The profile of the bullet is not, however, controlled by any industry or government regulations or guidelines, therefore the introduction of a differing sized caliber round in a given magazine may cause operational interruptions, such as jamming of the loading and/or feeding action of the magazine. This concern exists, regardless of the caliber of bullet used, whenever larger sized rounds are housed within a magazine originally adapted for a smaller round.

While larger caliber rounds, particularly those with large ojives, may fit within a magazine originally designed for smaller calibers, problems therefore oftentimes exist. As alluded to previously, this is because while the round of ammunition may well fit in the magazine itself, the ojive of such a round may be too large to allow the bullet to clear the tapered end 26 of the biasing arm 18 on the slide lever 16. As a result, the slide lever 16 would be moved upward with every new feed of ammunition into the chamber, causing the gun to malfunction and lock open with each and every round.

In some cases the firearm manufacturers have responded by decreasing the inward extension, or length, of the biasing arm 18 on the slide lever 16 in order to accommodate bullet designs of having varying degrees of ojive. This has proven to be an unreliable alteration as the firearm may then malfunction by not consistently locking the slide in its open position after the last round, since the extension by the biasing arm 18 into the magazine well can be marginal and, in certain instances, will miss the lip of the magazine follower 10 completely.

Indeed, certain manufacturers have in fact warned their customers to carefully select an ammunition to insure that neither of the above failure scenarios are present.

Other manufacturers have addressed this problem by designing wider and longer magazines and associated followers to provide a larger surface against which the biasing arm may engage the follower. This mandates, however, a larger firearm frame which is objectionable to many consumers causing them not to buy the product. In addition it requires more material and increases the weight of the firearm and generally increases the cost of the finished firearm.

With the forgoing problems and concerns in mind, it is the general object of the present invention to provide a magazine follower and assembly such that the need for an oversized frame is obviated, while still permitting a single magazine to be used in conjunction with multiple ammunition calibers having bullets of various ojives.

SUMMARY OF THE INVENTION

It is an object of the present invention to provide a magazine and slide lever assembly.

It is another object of the present invention to provide a magazine and slide lever assembly which is capable of accommodating rounds of ammunition having differing ojives.

It is another object of the present invention to provide a magazine and slide lever assembly which is capable of accommodating differing caliber rounds of ammunition.

It is another object of the present invention to provide a magazine and slide lever assembly which is capable of accommodating differing caliber rounds of ammunition without jamming, either during a loading or a feeding operation.

It is another object of the present invention to provide a magazine and slide lever assembly which is capable of accommodating differing caliber rounds of ammunition without increasing the size of other portions of the firearm, such as the handgrip portion.

It is another object of the present invention to provide a magazine and slide lever assembly which assuredly latches the slide of a firearm in its open position after the last round of ammunition has been discharged from the magazine.

It is another object of the present invention to provide a magazine and slide lever assembly which increases the manufacturing tolerances of the firearm.

It is another object of the present invention to provide a magazine and slide lever assembly which does not require a portion of the slide lever to protrude into the body of the magazine.

It is another object of the present invention to provide a magazine and slide lever assembly which is more easily and economically manufactured.

It is another object of the present invention to provide a magazine which does not interfere with the movement of the magazine follower housed within the magazine.

These and other objectives of the present invention, and their preferred embodiments, shall become clear by consideration of the specification, claims and drawings taken as a whole.

DETAILED DESCRIPTION OF THE PREFERRED EMBODIMENT

Figure 3:
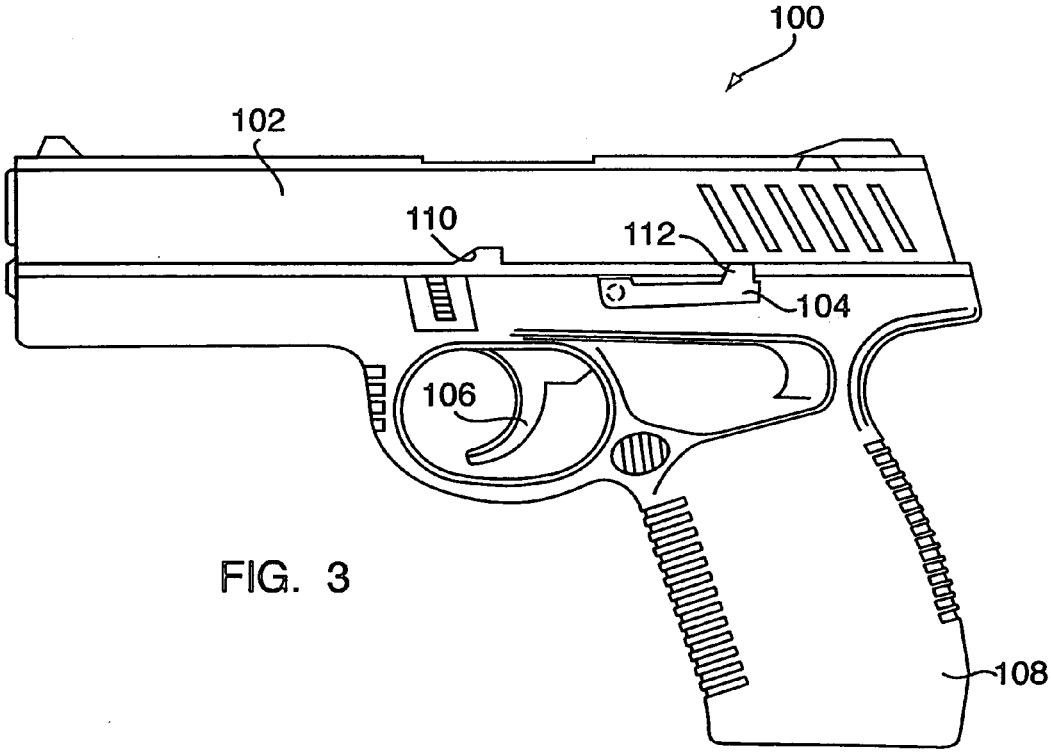
FIG. 3 is a planar, side view of a firearm equipped with a magazine and slide lever according to one embodiment of the present invention.

FIG. 3 illustrates a firearm 100 having a slide 102 and a slide lever 104 according to one embodiment of the present invention. The firearm 100 is designed to accept a magazine, itself holding a plurality of rounds of ammunition, in a magazine well that is formed in the handgrip portion 108 of the firearm 100. The firearm 100 discharges a round of ammunition from the magazine in a known fashion upon actuation of a trigger member 106.

Figure 4:
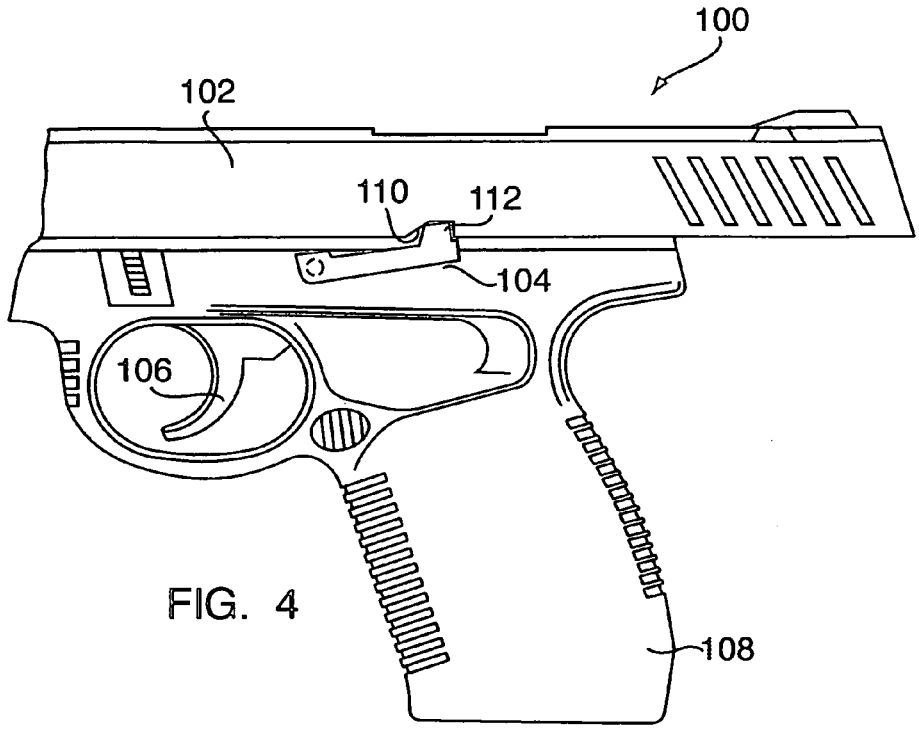
FIG. 4 is a planar, side view of the firearm shown in FIG. 3, wherein the slide of the firearm is latched in its open position.

It is an important aspect of the present invention that upon the discharge of the last round of ammunition, the slide 102 of the firearm 100 will become arrested in its open position, as shown in FIG. 4, through the interaction of a slide recess 110, formed in the slide 102, and a catch 112 provided on the slide lever 104. The manner in which the slide lever 104 assuredly arrests the slide 102 in its open position will become clear by a subsequent review of the drawing figures and their respective descriptions.

As discussed previously in conjunction with FIGS. 1 and 2, the performance of known slide levers and magazine assemblies suffer due to the marginal interaction between the lip 22 of the magazine follower 10 and the tapered distal end 26 of the biasing arm 18. That is, while it is vitally important for the biasing arm 18 to assuredly contact the lip 22 in order to assure that the catch 24 will be rotated to its engaging position with the firearm slide, care had to be taken to ensure that the biasing arm 18 did not extend too far into the body of the magazine 12, otherwise it was likely that jamming of the magazine would occur.

Moreover, designers of known slide levers and magazine assemblies were also aware that operators would occasionally load rounds of ammunition in the magazine 12 which were of larger caliber than was originally intended for the magazine 12. Designers therefore had to leave enough room between the distal end 26 of the biasing arm 18, and the face of the bullet head to ensure that there was still enough dimensional clearance to accommodate bullets having differing ojives. Hence, the tight tolerances to which known biasing arms 18 were previously fashioned, including the tapered end 26, resulted in either the sporadic disengagement of the tapered end 26 from the lip 22, thereby causing the failure of the catch 24 from arresting the firearm slide, or the unintended intrusion of the tapered end 26 too far in the body of the magazine 12, thereby causing jamming in the loading and feeding process, especially when larger-than-designed caliber rounds were utilized.

Figure 5:
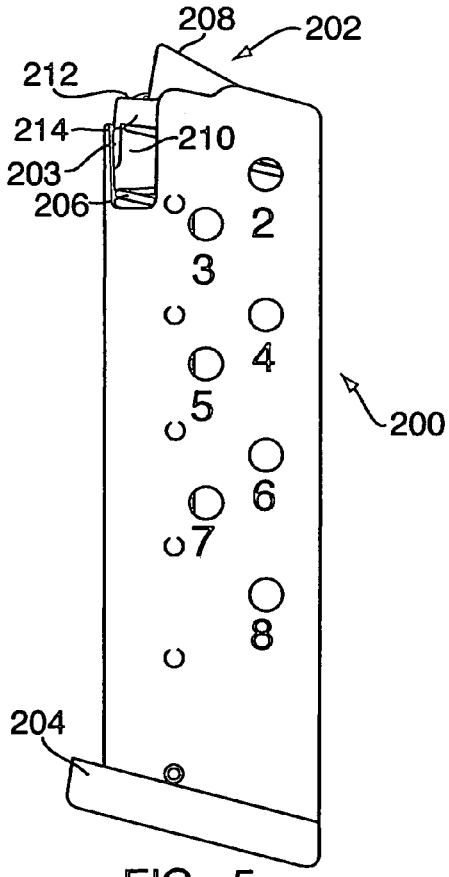
FIG. 5 is a planar, side view of a firearm magazine, according to one embodiment of the present invention.

The present invention seeks to overcome these drawbacks and restrictions by proposing new configurations for both the magazine and the slide lever. FIG. 5 illustrates a planar side view of a magazine 200 according to one embodiment of the present invention. As shown in FIG. 5, the magazine 200 includes a magazine follower 202 which sits atop a butt plate 204 and magazine spring 206 assembly for biasing the magazine follower 202 upwards in a feeding direction towards its empty position, shown in FIG. 5. The magazine follower 202 is characterized by upper, typically inclined, surface 208 which is adapted to receive a round.

The magazine 200 further includes a follower cutout 210 which has a greater depth than known magazine cutouts. As will be explained in more detail later, the deeper magazine cutout 210 enables a protruding lip 212 of the follower 202 to be biased out from the interior body of the magazine 200 well prior to the last round being removed from the magazine 200. The protruding lip 212 can be clearly seen in FIG. 6 as well.

Returning to FIG. 1, it can be seen that the magazine follower 10 includes a follower body 11 extending downwardly therefrom and into the body of the magazine 12, as is known. In particular, FIG. 1 shows that a front shroud 13 of the follower body 11 is disposed opposite a cutout 15 formed in the upper portion of the magazine 12 when the magazine follower 10 has been biased adjacent the upper portion of the magazine 12.

Figure 1:
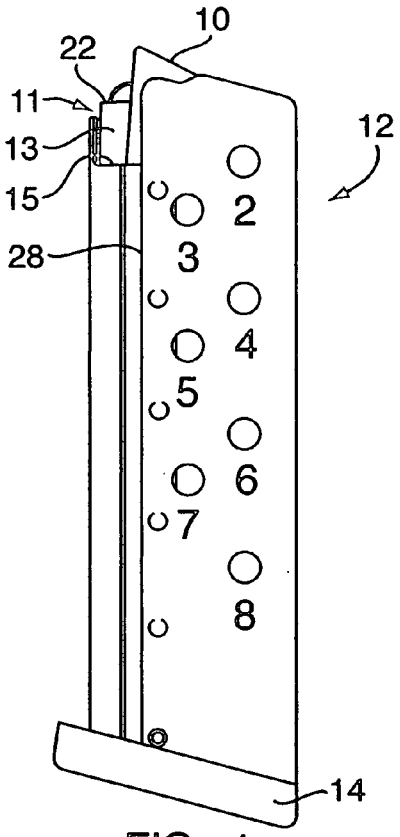
FIG. 1 Prior Art
FIG. 1 is a planar, side view of a known firearm magazine.
Figure 2:
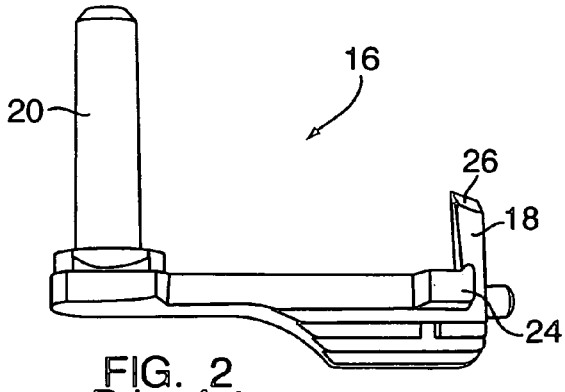
FIG. 2 Prior Art
FIG. 2 is a top view of a known slide lever.

In contrast to the known configuration of the follower body 11 shown in FIG. 1, FIG. 5 illustrates that the front leg, or shroud, of the follower 202 has been removed in the area opposite the cutout 210. That is, although the follower 202 also includes a follower body 203 extending downwardly therefrom and into the body of the magazine 200, the front shroud of the follower body 203 is removed so as not to be disposed opposite the cutout 210. By removing that portion of the follower 202 which faces the cutout 210, there is no impediment to the protruding lip 212 emerging from the interior body of the magazine 200 when the magazine follower 202 has been biased adjacent the upper portion of the magazine 200.

It is therefore another important aspect of the present invention that the front shroud of the follower 202 is removed adjacent the protruding lip 212 to ensure that the protruding lip 212 extends past the plane defined by the outer wall of the magazine 200. That is, without the absence of the front shroud of the follower 202, the protruding lip 212 would not emerge from the interior of the magazine 200 as early as it is capable of doing so with the front shroud being removed. Thus, as will be discussed in more detail later, the absence of the front shroud ensures the interaction between the protruding lip 212 and the biasing arm of the slide lever.

Returning to FIG. 5, it will be readily appreciated that the bottom 214 of the protruding lip 212 is beveled so as to facilitate the re-insertion of the follower 202, including the protruding lip 212, into the interior body of the magazine 200, as is necessary during the loading of rounds into the magazine 200.

Figure 6:
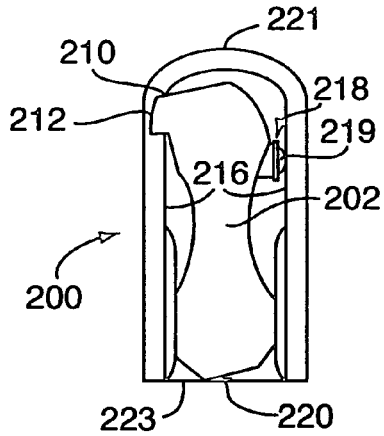
FIG. 6 is a top view of the firearm magazine shown in FIG. 5.

FIG. 6 illustrates a planar, top view of the magazine 200 and the follower 202. As shown in FIG. 6, the protruding lip 212 of the follower 202 is biased out of the cutout 210 and past the plane of the magazine wall 216. A spring loaded plunger 218 is anchored in the body of the follower 202 and provides the necessary biasing force to push the lip 212 out of the cutout 210 formed by the absence of the front shroud and past the plane of the magazine wall 216. The spring loaded plunger 218 shown in FIG. 6 is preferably embodied as a spring biased conical or rounded bearing element 219, thereby ensuring that the spring biased plunger 218 is capable of assuredly sliding within the magazine 200 during movement of the magazine follower 202 in the feeding direction.

While the spring loaded plunger 218 has been described as including a spring biased conical or rounded bearing element 219, it will be readily appreciated that other alternative biasing means may be utilized, such as but not limited to a leaf spring of the like, without departing from the broader aspects of the present invention.

It is therefore another important aspect of the present invention that a biasing element is provided to the follower 202 to ensure that the lip 212 emerges far enough out of the cutout 210, thus ensuring contact with the biasing arm of the slide lever when the lip 212 is moved upwards in the magazine 200 and opposite the cutout 210. It will be readily appreciated that while the spring loaded plunger 218 is designed to assuredly and repeatedly bias the lip 212 past the plane of the magazine wall 216, the biasing force of the spring loaded plunger 218 must not be so great as to impede the upward motion of the follower 202 under the urging of the magazine spring 206.

Another important aspect of the present invention resides in the orientation of the sealing, or mating, seam of the magazine wall 216. The magazine 200 defines an elongated housing and, as shown in FIG. 6, includes a rounded face 221 and an opposing planar face 223. A mating seam 220 is formed in the planar face 223 of the magazine 200, in contrast to the known magazine 12, shown in FIG. 1, where the seam 28 is formed adjacent the cutout area of the magazine 12. By orienting the seam 220 in the back, planar face 223 of the magazine 200 the present invention removes the possibility that the lip 212 may become snagged or jammed by a seam otherwise formed adjacent the cutout, as shown in FIG. 1.

Figure 7:
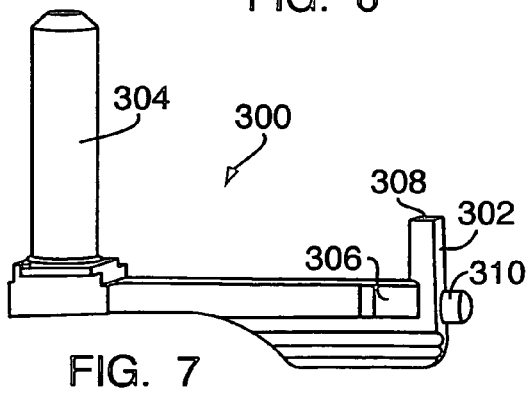
FIG. 7 is a top view of a slide lever, according to one embodiment of the present invention.

Turning now to FIG. 7, a slide lever 300 is shown in detail, according to one embodiment of the present invention. The slide lever 300 is substantially similar to the slide lever 104 shown in FIG. 4 and performs a similar function. As shown in FIG. 7, the slide lever 300 includes a biasing arm 302 as well as a post 304 that is integrally mated to the fame of the firearm 100 to permit selective pivoting of the slide lever 300. The slide lever 300 further includes a restraining catch 306 which is oriented to become engaged with the slide recess 110 of the slide 102 when the biasing arm 302 is rotated upwards via the lip 212 of the magazine follower 202. In contrast to the known slide lever illustrated in FIG. 2, the distal end 308 of the biasing arm 302 is not tapered.

It is therefore another important aspect of the present invention that the biasing arm 302 of the slide lever 300 is shorter than the biasing arm 18 of the known slide lever 16, as the biasing arm 302 need not extend into the cutout 210 of the magazine 200 in order to contact the lip 212. That is, by utilizing the spring loaded plunger 218 to bias the lip 212 past the plane of the magazine wall 216, there no longer exists any reason for the biasing arm 302 to extend in the interior body of the magazine 200. Thus, the present invention assuredly prevents the biasing arm 302 from interfering or jamming any round of ammunition loaded into the magazine 200, regardless of the caliber or ojive of the round utilized.

It will also be readily appreciated that by reducing the length and eliminating the tapered end of the biasing arm 302, the slide lever 300 of the present invention is more easily and economically produced. Indeed, another important aspect of the present invention is that the manufacturing tolerances for both the magazine 200 and the slide lever 300 are greatly increased, given the protruding nature of the lip 212 which both ensures contact with the biasing arm 302 while simultaneously relieving the burden on the biasing arm 302 from the possible interference with the ojive of a loaded round of ammunition.

It will also be readily appreciated that the present invention is applicable to single stack magazines, as well as those magazines where there is a stagger to the arrangement of rounds so that the rounds of ammunition are in received in what is referred to as a double stack configuration.

Regardless of a single stack or double stack design, the present invention ensures that there is a portion of the follower which is not encompassed by the bullet profile, or ojive, regardless of the caliber of the round loaded in the magazine.

Indeed, it is another important aspect of the present invention that, when taken together, the slide lever 300 and the magazine 200 enable differing calibers of rounds to be selectively loaded into the magazine 200 without fear from jamming due to the differing ojives of these rounds. This flexibility, without fear of jamming, is heretofore unknown in the art and does not require the manufacture of larger firearm components, such as wider magazines and grip portions of the firearm, to be successful.

In operation, when the follower 202 is disposed opposite the cutout 210 of the magazine 200, the lip 212 of the follower 202 will emerge from the interior body of the magazine 200 under the biasing force of the spring loaded plunger 218. The lip 212 will extend beyond the plane of the magazine wall 216 and thereby contact the biasing arm 302 of the slide lever 300 which extends towards, but not into, the interior body of the magazine 200. Further feeding of the magazine 200 will cause the slide lever 300 to rotate about the post 304 until the last round is fed from the magazine 200. Upon the feeding of the last round, the lip 212 will cause the slide lever 300 to rotate to such an extent that the slide lever 300 will overcome the biasing force of a spring loaded pin 310, thus permitting the restraining catch 306 to contact the slide recess 110 and arrest the slide 102 in its open position. Such an operation is enabled regardless of the caliber or ojive of the rounds loaded into the magazine 200.

Moreover, it is still yet another important aspect of the present invention that by providing the magazine 200 with a deeper cutout 210, an earlier interaction between the protruding lip 212 and a biasing arm 302 of the slide lever 300 may be accomplished.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A firearm having a slide, said firearm comprising:

a magazine for accommodating a round of ammunition therein;

a magazine follower disposed within said magazine, said magazine follower supporting said round of ammunition and including a protruding lip extending outwardly therefrom;

wherein a distal end of said protruding lip extends beyond a plane defined by an outer wall of said magazine and said magazine defines an elongated housing having a rounded face disposed substantially opposite a planar face; and wherein a mating seam of said magazine is formed in said planar face.

2. The firearm according to claim 1, further comprising:

a biasing member operatively connected to said magazine follower, said biasing member urging said distal end of said protruding lip beyond said plane defined by said outer wall of said magazine.

3. The firearm according to claim 1, further comprising:

a slide lever having a biasing arm which selectively communicates with said distal end of said protruding lip when said protruding lip extends beyond said outer wall of said magazine.

4. The firearm according to claim 3, wherein:

said biasing arm includes a non-tapered distal end.

5. The firearm according to claim 3, wherein:

said slide lever includes a restraining catch and selectively pivots between an engaging position in which said restraining catch engages a slide recess in said slide, and a non-engaging position in which said restraining catch does not engage said slide recess; and said restraining catch pivots to said engaging position when said biasing arm communicates with said protruding lip.

6. The firearm according to claim 3, wherein:

said slide lever includes a restraining catch; and movement of said slide is arrested when said restraining catch engages a recess in said slide.

7. The firearm according to claim 3, further comprising:

a magazine spring disposed within said magazine, said magazine spring urging said magazine follower upward in a feeding direction; and said protruding lip communicates with said biasing arm when said magazine spring has biased said magazine follower adjacent an upper portion of said magazine.

8. The firearm according to claim 1, further comprising:

a cutout formed adjacent an upper portion of said magazine;

a follower body extending downwardly from said magazine follower and into an interior of said magazine; and wherein said follower body is configured such that said follower body is not disposed opposite said cutout when said magazine follower has been biased adjacent said upper portion of said magazine.

9. A firearm having a slide, said firearm comprising:

a magazine;

a magazine follower disposed within said magazine, said magazine follower having a protruding lip extending outwardly therefrom;

a biasing member operatively connected to said magazine follower;

wherein a distal end of said protruding lip is urged by said biasing member to extend beyond a plane defined by an outer wall of said magazine and said magazine defines an elongated housing having a rounded face disposed substantially opposite a planar face; and wherein a mating seam of said magazine is formed in said planar face.

10. The firearm according to claim 9, further comprising:

a cutout formed in an upper portion of said magazine; and wherein said distal end extends beyond said plane defined by said outer wall of said magazine when said protruding lip is disposed opposite said cutout.

11. The firearm according to claim 9, further comprising:

a slide lever having a biasing arm which selectively communicates with said distal end of said protruding lip when said protruding lip extends beyond said outer wall of said magazine.

12. The firearm according to claim 11, wherein:

said biasing arm includes a non-tapered distal end.

13. The firearm according to claim 11, wherein:

said slide lever includes a restraining catch and selectively pivots between an engaging position in which said restraining catch engages a slide recess in said slide, and a non-engaging position in which said restraining catch does not engage said slide recess; and said restraining catch pivots to said engaging position when said biasing arm communicates with said protruding lip.

14. The firearm according to claim 11, wherein:

said slide lever includes a restraining catch; and movement of said slide is arrested when said restraining catch engages a recess in said slide.

15. The firearm according to claim 11, further comprising:

a magazine spring disposed within said magazine, said magazine spring urging said magazine follower upward in a feeding direction; and said protruding lip communicates with said biasing arm when said magazine spring has biased said magazine follower adjacent an upper portion of said magazine.

16. The firearm according to claim 9, further comprising:

a follower body extending downwardly from said magazine follower and into an interior of said magazine; and wherein said follower body is configured such that said follower body is not disposed opposite said cutout when said magazine follower has been biased adjacent said upper portion of said magazine.

17. The firearm according to claim 9, wherein: said distal end of said protruding lip is beveled.

* * * * *